United States Patent [19]

Roberts et al.

[11] 3,954,068

[45] May 4, 1976

[54] FOLDING TABLE

[76] Inventors: Donald Lester Roberts; Sadie Roberts; Brenda Jo Roberts; Deborah Ann Roberts, all of 2697 E. 55th Way, N. Long Beach, Calif. 90805

[22] Filed: Apr. 9, 1975

[21] Appl. No.: 566,191

[52] U.S. Cl. ..... 108/124

[51] Int. Cl.[2] ..... A47B 3/00

[58] Field of Search ..... 108/115, 118, 119, 124, 108/129, 132, 134, 157; 248/188.8

[56] References Cited

UNITED STATES PATENTS

| | | | |
|---|---|---|---|
| 2,857,228 | 10/1958 | Koett | 108/115 |
| 2,879,118 | 3/1959 | Kolb | 108/115 |
| 3,108,550 | 10/1963 | Knoblock | 108/124 |
| 3,247,811 | 4/1966 | Bauder | 108/115 |

*Primary Examiner*—James C. Mitchell
*Attorney, Agent, or Firm*—Robert K. Wallor

[57] ABSTRACT

A table-tray combination having a foldable supporting structure consisting of a pair of legs, held in a vertical position by bases pivoted from the lower ends of each leg and locked in place by slotted braces and detent studs. An arm frame, pivoted from the upper middle region of each leg, forms, together with the upper ends of the legs, the plane to which the detachable tray is clipped. When the bases and arm frame are folded for storage, the structure and tray assume an essentially flat shape. Clips, rigidly attached to each leg, hold the folded structure for storage and preclude opening them improperly.

3 Claims, 6 Drawing Figures

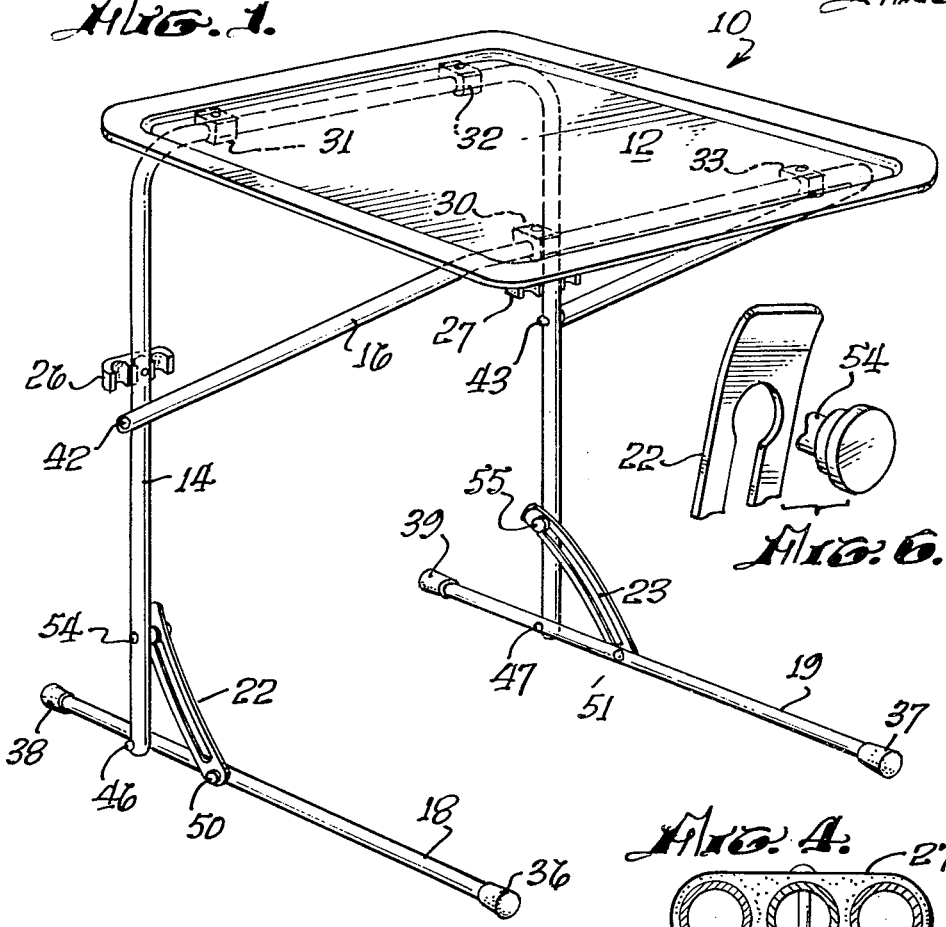
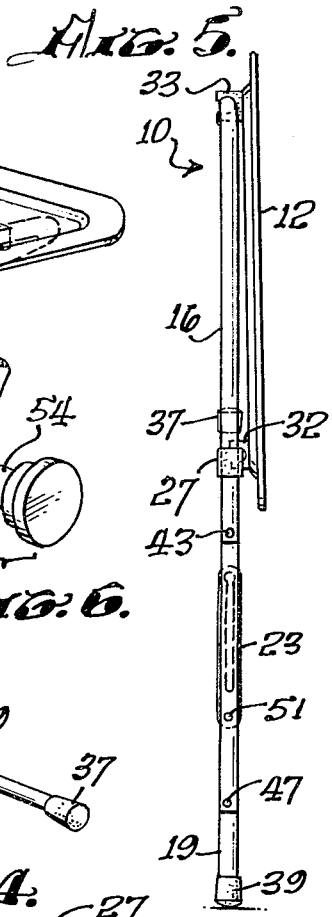
FIG. 6.
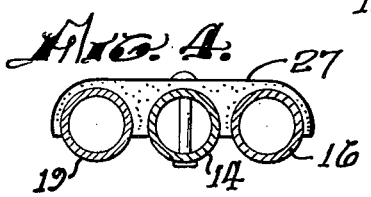
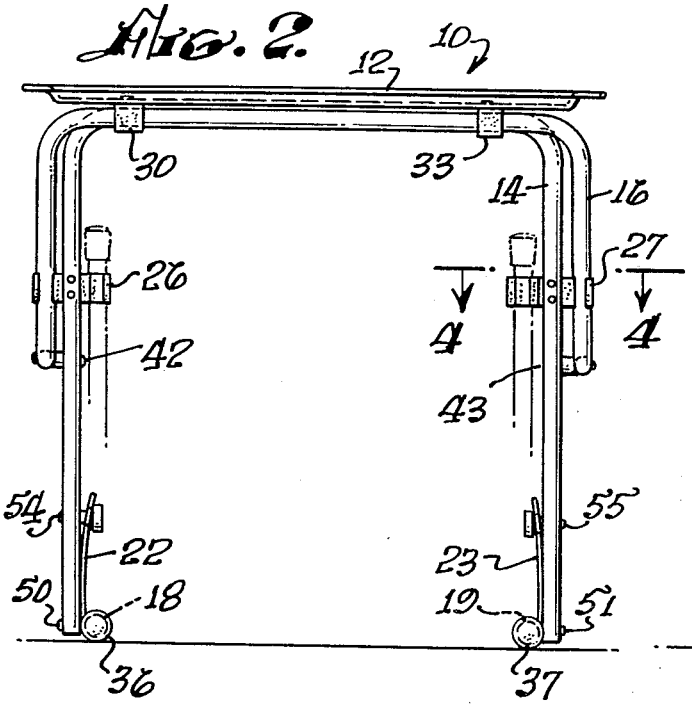
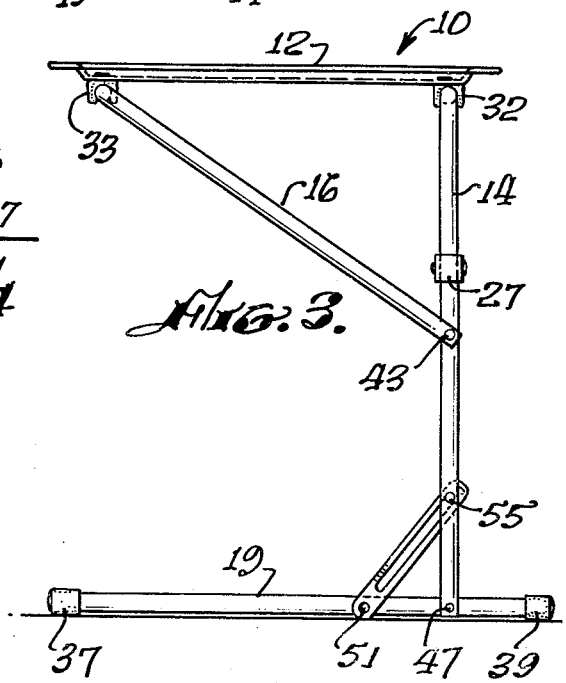

FOLDING TABLE

CROSS REFERENCES TO RELATED APPLICATIONS

This disclosure reflects continued development of the invention disclosed in Disclosure Document No. 026387, dated December 14, 1973.

BACKGROUND OF THE INVENTION

This invention relates to a table having a hinged or detachable tray surface and a foldable support structure, wherein the tray surface is pivotally cantilevered at one edge from a pair of legs, supported by base members in a vertical position. An arm structure, pivotally attached to the upper central region of the legs, supports the free edge of the tray surface. The assembly assumes a substantially flat form when folded for storage.

Tray tables having a hinged or detachable tray surface and a folding support structure have been heretofore described in a variety of embodiments. Among the prior art found that approach the object or structure of the present invention are the U.S. Pat. Nos. issued to Campbell 3,646,895, Crevoi 3,031,243, Zierhut 3,191,554, Gaudette 2,471,564, and Flagstad 2,060,367. Others of a similar nature, predating the above, were also discovered, but they are not listed here since they are referenced in the listed Patents. None of the above, however, employ the cantilever support structure principle of this invention. Prior characterizations have, in general, relied upon two pairs of scissors type legs to form their supporting structure. That leg arrangement often restricts the location of tray surface, when used relative to a chair or sofa wherein a user may be seated, to an area immediately forward of the front edge of said seating device, thereby reducing the convenience of access to the tray surface by a fully seated user. Further, the base area encompassed by the lower extremities of the four legs is nominally the same as the surface area of the tray, thus providing limited stability for oversized or unbalanced loads on the tray surface or for tipping moments applied to the structure.

The present invention, through its cantilever support structure, permits the tray to be drawn toward a fully seated user. Additionally, the stability of this device, particularly for tipping moments away from the user, is enhanced by the length of the base members.

SUMMARY OF THE INVENTION

The nature of the invention herein described concerns the cantilevered support structure for the hinged or detachable tray surface. In use, a tubular, inverted U-shaped leg member is held in a vertical position by two tubular base members, one pivotally attached to the lower end of each leg. Said base members are of sufficient length as to extend horizontally toward the user approximately the same distance as the tray surface. An additional length of each base member extends beyond the pivotal joint with the leg in a direction opposite to the cantilevered tray surface. The base members are retained orthogonally to the plane formed by the U-shaped leg member by spring locking slotted brace members. A second tubular U-shaped member, serving as an arm member, is pivotally attached, through its ends, to the leg segments of the leg member near their mid-points. The lengths of the parallel segments of the arm member are proportioned such that, when the arm is pivoted away from the leg member, the crossing segments of the two U-shaped members form a horizantal plane to which a tray surface may be affixed by clamp or clip means. The tray surface itself provides the structural rigidity to maintain the arm member at the proper attitude with respect to the leg member.

This cantilevered support structure allows the user of this table to slide the base members under his chair or sofa, thereby permitting him to draw the tray surface into close proximity to his seated position. Full clearance is provided for the user's legs beneath the U-shaped arm and leg member. The length of the base members, particularly the short base segments extending away from the cantilever, provide great stability.

When the tray surface is detached or pivoted from the supporting structure, said structure may be folded about its pivot points such that the base members, the leg member, and the arm member become clamped in a coplanar manner, providing thereby an essentially flat assembly for storage.

BRIEF DESCRIPTION OF THE DRAWINGS

FIG. 1 is a perspective view of the table unfolded for use, illustrating, in broken line form, the positioning of the tray surface clips relative to the leg and arm members.

FIG. 2 is a front elevation of the table set up for use, and also indicating the stored elevation of the base members.

FIG. 3 is the side elevation view of the table in use, as taken from the right of FIG. 1.

FIG. 4 is an enlarged fragmentary sectional view taken on line 4—4 of FIG. 2, and illustrating the method of attachment and use of the storage clip.

FIG. 5 is a side elevation of the table in its stored position, as taken from the left of FIG. 1.

FIG. 6 is a fragmentary perspective of the stored brace member and its guide and locking stud mounted on the leg member.

DESCRIPTION OF THE PREFERRED EMBODIMENT

As indicated throughout the several views of the drawing, a foldable table 10 is provided which may be readily unfolded and set up for use by grasping the U-shaped leg member 14 with one hand and then pivoting the base members 18, 19 with the other hand from their slots in clips 26, 27, causing the slotted brace members 22, 23 to slide along their respective studs 54, 55 until the base members 18, 19 are orthogonal to the legs 14, at which time the enlarged portion of the slot of the brace members 22, 23 will engage an enlarged diameter of the studs 54, 55 by spring action thereby hold the base members 18, 19 and the legs 14 at, rigidly, right angles. By then grasping the U-shaped arm member 16, it can be pivoted away from the clips 26, 27 to the appropriate angle for clipping the tray surface 12 to the leg 14 and arm 16 members by clips 30, 31, 32, and 33.

The table 10, when in use, is structured to support the tray surface 12 as illustrated in FIG. 1. An upright, inverted U-shaped tubular leg member 14, formed as shown in FIG. 2, provides the vertical support for the structure. The leg 14 is maintained in a vertical position by two tubular base members 18, 19 attached to the lower extremities of the leg member 14 by pivots 46, 47 which rest horizantally on a reference surface. The point of pivot 46, 47 on the base members 18, 19 is located approximately one fifth of the distance from one end, as shown in FIG. 3. The leg member 14 is maintained orthogonal to the horizantally placed base members 18, 19 by brace members 22, 23, pivotally attached to the base members 18, 19 at the pivots 50, 51, said braces formed of slotted straps having the slots riding on studs 54, 55, rigidly affixed to the leg member 14. These braces are of common design and are used in a variety of applications, principally folding card tables. A detail of the locking feature of the slotted brace 22, 23 and the stud 54, 55 is shown by FIG. 6.

A second, inverted U-shaped, tubular arm member 16, formed as shown in FIG. 2 is attached by pivot means 43, 43 through the lower extremities of said arm member 16 to the approximate mid-points of the depending segments of said leg member 14. The lengths of the depending segments of said arm member 16 are equal and proportional such that, when the tray surface 12 is attached to the horizontal traverse segments of the arm member 16 and the leg member 14 by the clip means 30, 31, 32, 33, the tray surface is rigidly supported in a horizontal plane.

One of two formed clip members 26, 27, shown in section in FIG. 4, is rigidly affixed by rivet means to each of the depending segments of the leg member 14 slightly above the arm member 16 pivot points 42, 43. Said clip members hold the arm member 16 and the base members 18, 19 in a parallel planar arrangement when the table is folded for storage, as shown in FIG. 5. The manner of clipping of the base members 18, 19 is indicated by the broken lines superimposed on FIG. 2.

MODIFICATION AND OTHER EMBODIMENTS

The preferred embodiment illustrated in FIGS. 1 through 6 represents the best use of an essentially tubular materials construction supplemented by the fasteners, caps, clips, and braces. A modification involves the use of channel formed material for the frame members.

In another embodiment the tray surface clips 30, 33 shown on FIG. 1 are replaced by clasp members that surround the horizontal traverse segment of the arm member 16 such that the tray surface may pivot about said segment of the arm 16 but may not be detached therefrom. In this embodiment, the table 10 when set up for use as in FIG. 3 can be folded for storage as in FIG. 5 by unclipping the tray surface 12 by means of the clips 31, 32 from the horizontal traverse segment of the leg member 14, and then carrying the tray surface 12 over said segment of the leg member 14, thereby causing the arm member 16 to rotate about the pivots 42, 43 in a clockwise manner as seen in FIG. 3, until the arm member 16 reaches a vertical position and engages the clip members 26, 27, said arm 16 becoming held in place thereby. The tray surface 12 may now be lowered to assume a nearly vertical planar position as shown in FIG. 5.

A further embodiment replaces the slotted brace members 22, 23 and locking studs 54, 55 by hinged, two piece standard folding brace members, attached by pivot means to both the base member 18, 19 and to the leg member 14.

SUMMARY OF ADVANTAGES

Whatever may be the modification or a new embodiment, the purpose remains to provide a foldable table which is readily folded for storage and unfolded for use.

In use, the cantilevered support of the tray surface permits the table to be drawn in toward the user for comfort and convenience.

The overall structure, its strength, and its size may be adapted to many uses. Initially the tables were designed for use as the portable so called TV tray. However, these tables may be used as writing surfaces in auditoriums, as food service or entertainment surfaces in hospitals or bedrooms, or as portable supporting stands for a variety of devices such as projectors, sound reproducing devices, etc.

The durability and stability of the cantilevered approach provides the major basis for the inventions claimed.

We claim:

1. A folding table comprising a tray surface, an inverted U-shaped leg member, depending from, and attached to said tray surface adjacent to one edge thereof by clip means grasping the horizontal traverse segment of said leg member, an inverted U-shaped arm member, depending from, and attached to said tray surface adjacent to an opposite edge thereof, by clip means grasping the horizontal transverse segment thereof with the lower extremities of said arm member pivotally attached to the leg member approximately at the mid-points of the vertical segments of said leg member, forming a cantilevered support for said tray surface, two base members, one pivotally attached to the lowest extremity of each vertical segment of said leg member such that said base members are mutual parallel and when folded away from said leg segments about the pivot points, orthogonally intersect the line joining said pivot points on the two vertical leg segments, said pivot points on said base members being situated such that approximately four-fifths of said base members extends beneath the tray surface, two brace members, one pivotally attached to each base member in a direction toward the arm member supported edge of the cantilevered tray surface, with the brace members being of the standard slotted type having enlarged circular areas near the ends opposite the pivots to engage the interim diameter of studs affixed to each vertical leg segment at a distance above the lowest extremity of said segments equal to the separation of the brace and base to leg pivot points along the base members, said braces locking said base members at right angles to said vertical leg segments by spring action, two clip members, each formed generally as a rectangular parallelopiped, having three equally spaced circular cross-section grooves formed, transverse to the long dimension, on one surface, with slightly more than half the circular section embedded into said clip member, and having the outer corners of the surface opposite the grooves aesthetically rounded, one of said clip members being rigidly attached to each vertical leg segment, said leg segment passing through the central of the three grooves, above the aforementioned arm member pivot points, at a distance not exceeding that which would permit the folded base members from engaging one of the outer grooves in said clip member, and four "cane tip" type protective caps, one placed over each end of each base member, the entire structure being supported by the base members placed horizontal on a reference surface, thereby holding the leg member in a vertical position and thereby supporting the tray surface in a horizontal plane, said structure being capable of folding such that the base members pivot internal to the separation between the vertical segments of the leg member, being held parallel to said segments by the clip members, and the arm member pivots external to said leg member segments, also to be held vertical by said clip members, with the tray surface forming a nearly vertical plane adjacent to the plane of the folded structure, said tray surface being attached by clip means to the horizontal transverse segment of the arm member.

2. A folding table as defined in claim 1, having said tray surface permanently affixed to said horizontal transverse segment of said arm member in a circumferentially pivotal manner.

3. The folding table of claim 2 in which said brace members are comprised of two segments, pivotally connected at one end of each segment and when extended, pivotally attached at the opposite ends to the base members and leg member, respectively.

* * * * *